US010697204B1

(12) United States Patent
Chen et al.

(10) Patent No.: US 10,697,204 B1
(45) Date of Patent: Jun. 30, 2020

(54) DRAWER LOCKING APPARATUS OF CABINET

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKECo., Ltd., Taichung (TW)

( * ) Notice: Subject to any disclaimer, the term of this patent is extended or adjusted under 35 U.S.C. 154(b) by 0 days.

(21) Appl. No.: 16/399,752

(22) Filed: Apr. 30, 2019

(51) Int. Cl.

| | |
|---|---|
| ***E05B 65/462*** | (2017.01) |
| ***A47B 88/919*** | (2017.01) |
| ***E05C 19/10*** | (2006.01) |
| *A47B 63/00* | (2006.01) |
| *B25H 3/04* | (2006.01) |
| *A47B 88/938* | (2017.01) |

(52) U.S. Cl.
CPC ..... *E05B 65/462* (2013.01); *A47B 88/919* (2017.01); *E05C 19/10* (2013.01); *A47B 63/00* (2013.01); *A47B 2088/94* (2017.01); *B25H 3/04* (2013.01); *E05Y 2900/20* (2013.01)

(58) Field of Classification Search
CPC ..... A47B 88/94; A47B 88/919; A47B 63/00; E05C 19/10; E05B 65/462; E05B 65/463; B25H 3/04
USPC ..... 312/216–221
See application file for complete search history.

(56) References Cited

U.S. PATENT DOCUMENTS

| | | | | |
|---|---|---|---|---|
| 6,347,848 | B1 * | 2/2002 | Cho | E05B 65/462 292/DIG. 18 |
| 6,572,203 | B1 * | 6/2003 | Cheng | E05B 65/462 292/DIG. 18 |
| 6,719,380 | B1 * | 4/2004 | Liu | B25H 3/028 312/217 |
| 6,742,854 | B2 * | 6/2004 | Chen | E05B 65/463 312/217 |
| 7,784,887 | B2 * | 8/2010 | Grela | B25H 3/028 312/218 |
| 9,901,170 | B2 * | 2/2018 | Tam | A47B 81/00 |
| 10,273,721 | B1 * | 4/2019 | Chen | E05B 65/462 |
| 2006/0138912 | A1 * | 6/2006 | Chen | E05B 65/462 312/217 |
| 2007/0278913 | A1 * | 12/2007 | Liu | B25H 3/028 312/220 |
| 2008/0279490 | A1 * | 11/2008 | Holcomb | E05B 17/007 384/42 |

* cited by examiner

*Primary Examiner* — Daniel J Troy
*Assistant Examiner* — Timothy M Ayres

(57) ABSTRACT

A cabinet includes at least one hook on a rear end of a bottom of a drawer. Turning a rod in one direction turns a pushing member which in turn lifts sliding members along poles via a linking bar so that the hook may pass an aperture of the pole and a hole of the sliding member in an unlocked position of the drawer. To the contrary, turning the rod in the other opposite direction turns the pushing member which in turn drops the sliding members so that the hook is blocked from passing the aperture of the pole and the hole of the sliding member in a locked position of the drawer.

1 Claim, 15 Drawing Sheets

DRAWER LOCKING APPARATUS OF CABINET

BACKGROUND OF THE INVENTION

1. Field of the Invention

The invention relates to drawer locking apparatuses and more particularly to a drawer locking apparatus of a file cabinet or a tool cabinet.

2. Description of Related Art

A conventional file or tool cabinet is a substantially rectangular case body with six faces. The case body is formed by a plurality of panels defining a space therebetween. A plurality of drawers are horizontally disposed in the space layer by layer for placing documents or tools therein. In order to prevent the documents or tools from being stolen or prevent the drawers from dropping out due to shock or inclination of the ground, the file or tool cabinet is equipped with a locking device for locking the drawers.

For locking the respective drawers at one time, U.S. Pat. No. 6,347,848 disclose a drawer locking apparatus of a cabinet, including a cabinet body, at least one drawer slidably disposed in the cabinet body, a base seat mounted in the cabinet body, a slide section slidably fitted in the base seat, an engaging section and a dogging device. One end of the engaging section is disposed on the slide section. The other end of the engaging section has a hook plate with a guide slope for hooking rear sideboard of the drawer. The dogging device serves to drive the slide section to slide between a first position and a second position.

While the device enjoys its success in the market, continuing improvements in the exploitation of drawer locking apparatus of cabinet of this type are constantly being sought.

SUMMARY OF THE INVENTION

It is therefore one object of the invention to provide a cabinet comprising a plurality of drawers each including at least one hook on a rear end of a bottom; a rod having one end proximate a center of a rear end of a top of the cabinet and the other end extending out of a front end of the top thereof wherein one end of the rod in a hollow support is bent to form a pushing member; a hollow first pole proximate the center of the rear end of the cabinet and including a plurality of apertures facing the hooks and configured to allow the hooks to pass through; a hollow first sliding member disposed in the first pole and including two side extensions on a top and a plurality of holes facing the apertures of the first pole; a plurality of first guide members in the first sliding member and secured to the center of the rear end of the cabinet; a hollow second pole proximate one side of the cabinet and including a plurality of apertures facing the hooks and configured to allow the hooks to pass through; a hollow second sliding member in the second pole and including a through hole on a top and a plurality of holes facing the apertures of the second pole so that the hook is configured to insert through the aperture of the second pole into the hole of the second sliding member; a plurality of second guide members in the second sliding member and secured to a left portion of the rear end of the cabinet so that the second sliding member is capable of vertically sliding between the second pole and the second guide members; a hollow third pole proximate the other side of the cabinet and including a plurality of apertures facing the hooks and configured to be inserted through by the hooks; a hollow third sliding member in the third pole and including a through hole on a top and a plurality of holes facing the apertures of the third pole so that the hook is configured to insert through the aperture of the third pole into the hole of the third sliding member; a plurality of third guide members in the third sliding member and secured to a right portion of the rear end of the cabinet so that the third sliding member is capable of vertically sliding between the third pole and the third guide members; and a linking bar horizontally disposed on tops of the first pole, the second pole, and the third pole and configured to pass through the support, the linking bar including a through hole with the pushing member passing through, two limit plates at two sides respectively and urging against the second pole and the third pole respectively, two slots proximate the limit plates respectively and aligned with the through hole of the second sliding member and the through hole of the third sliding member respectively.

The above and other objects, features and advantages of the invention will become apparent from the following detailed description taken with the accompanying drawings.

DETAILED DESCRIPTION OF THE INVENTION

Figure 1:
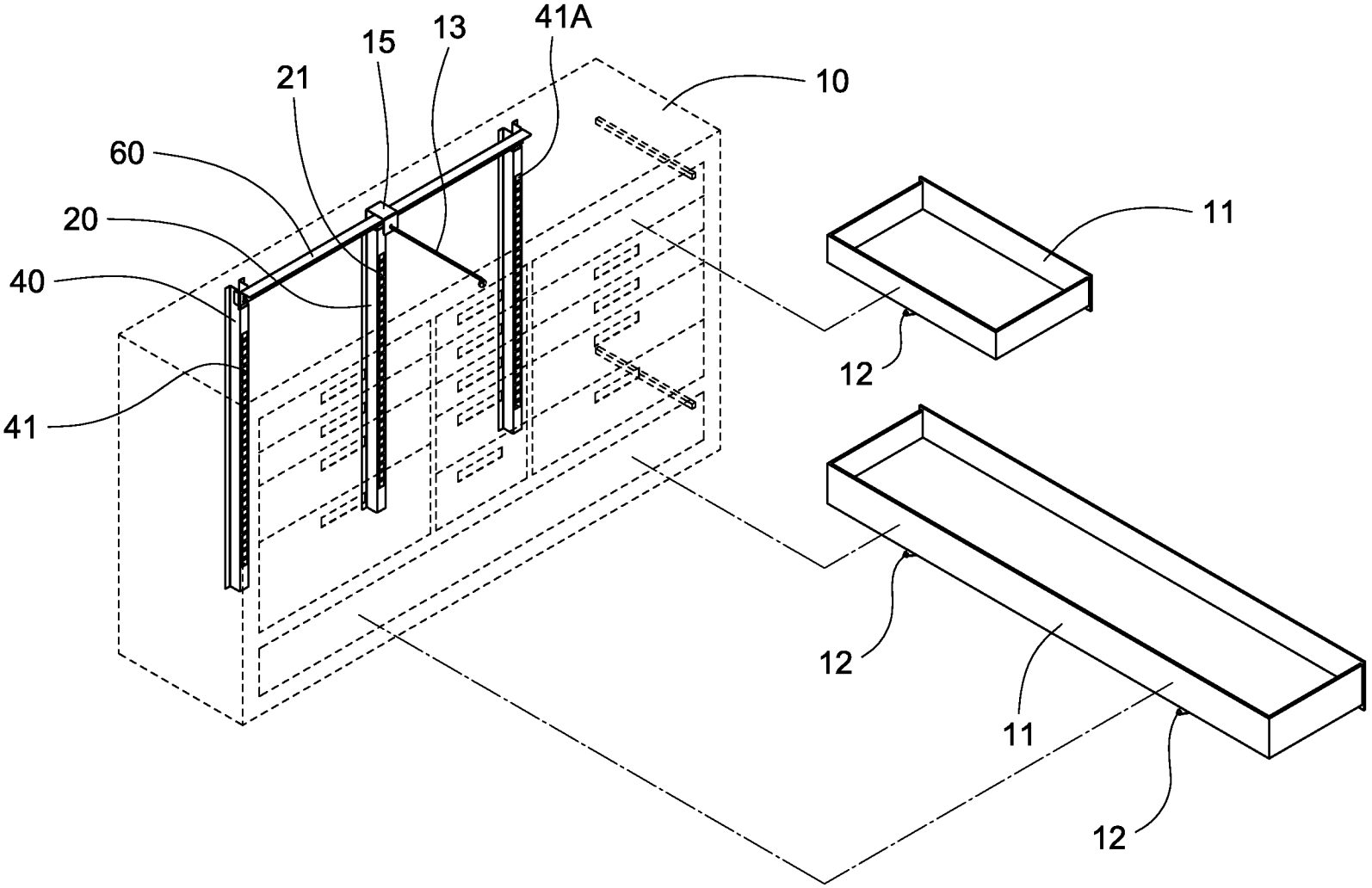
FIG. 1 is an exploded, perspective, phantom view of a cabinet incorporating a drawer locking apparatus according to a first preferred embodiment of the invention.
Figure 2:
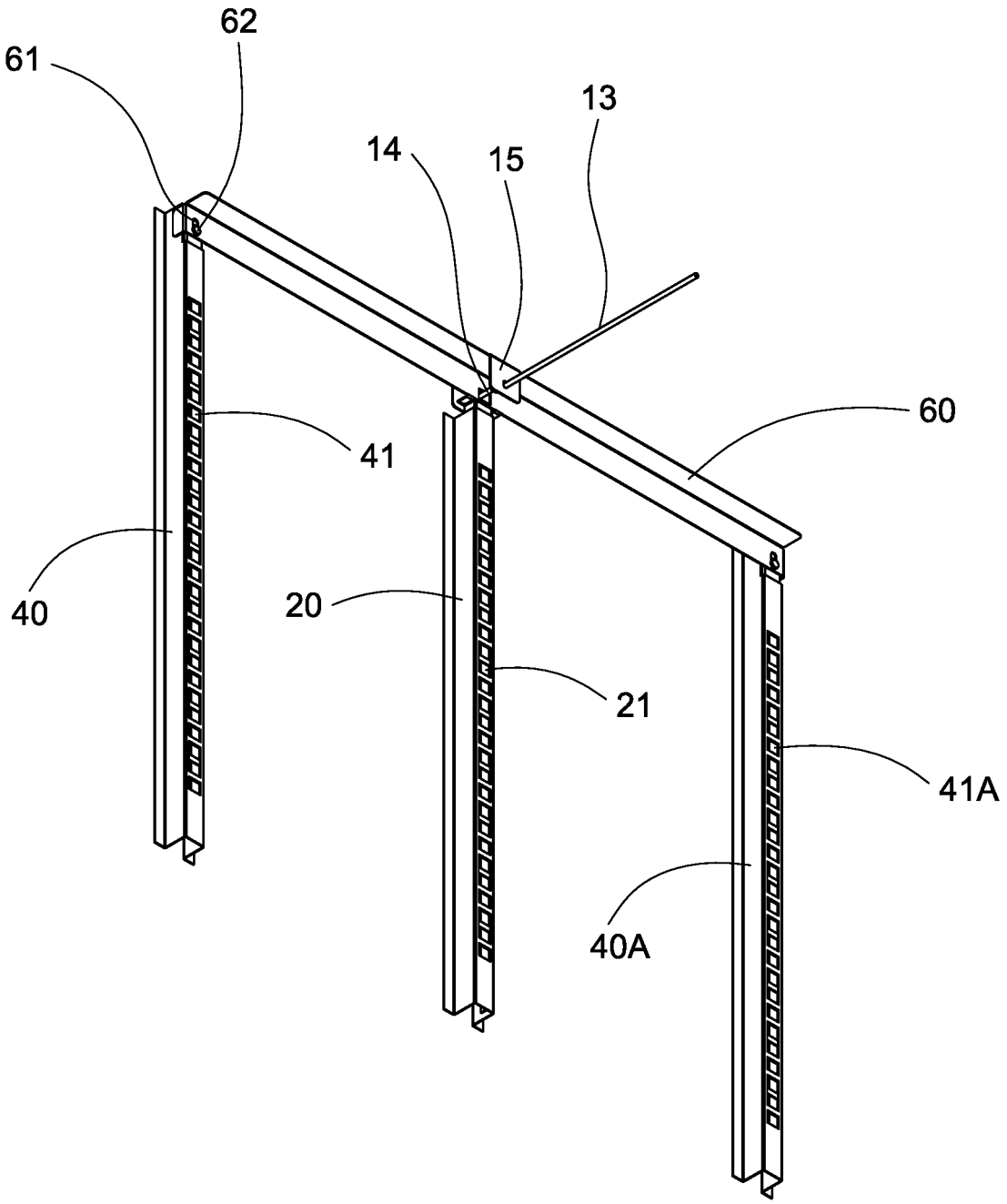
FIG. 2 is a perspective view of the support, the linking bar, the rod and the poles.
Figure 3A:
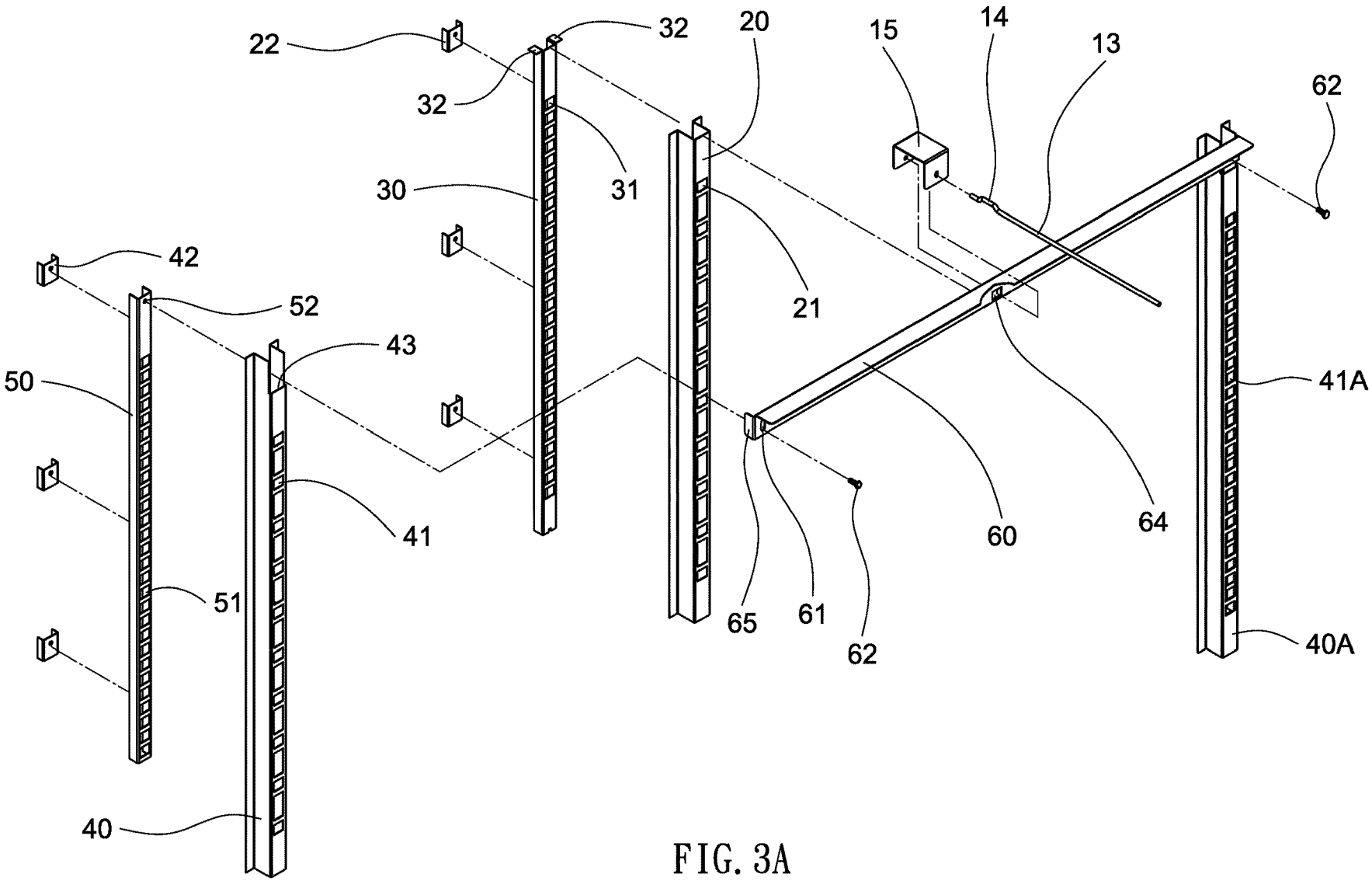
FIG. 3A is an exploded view of FIG. 2.
Figure 3B:
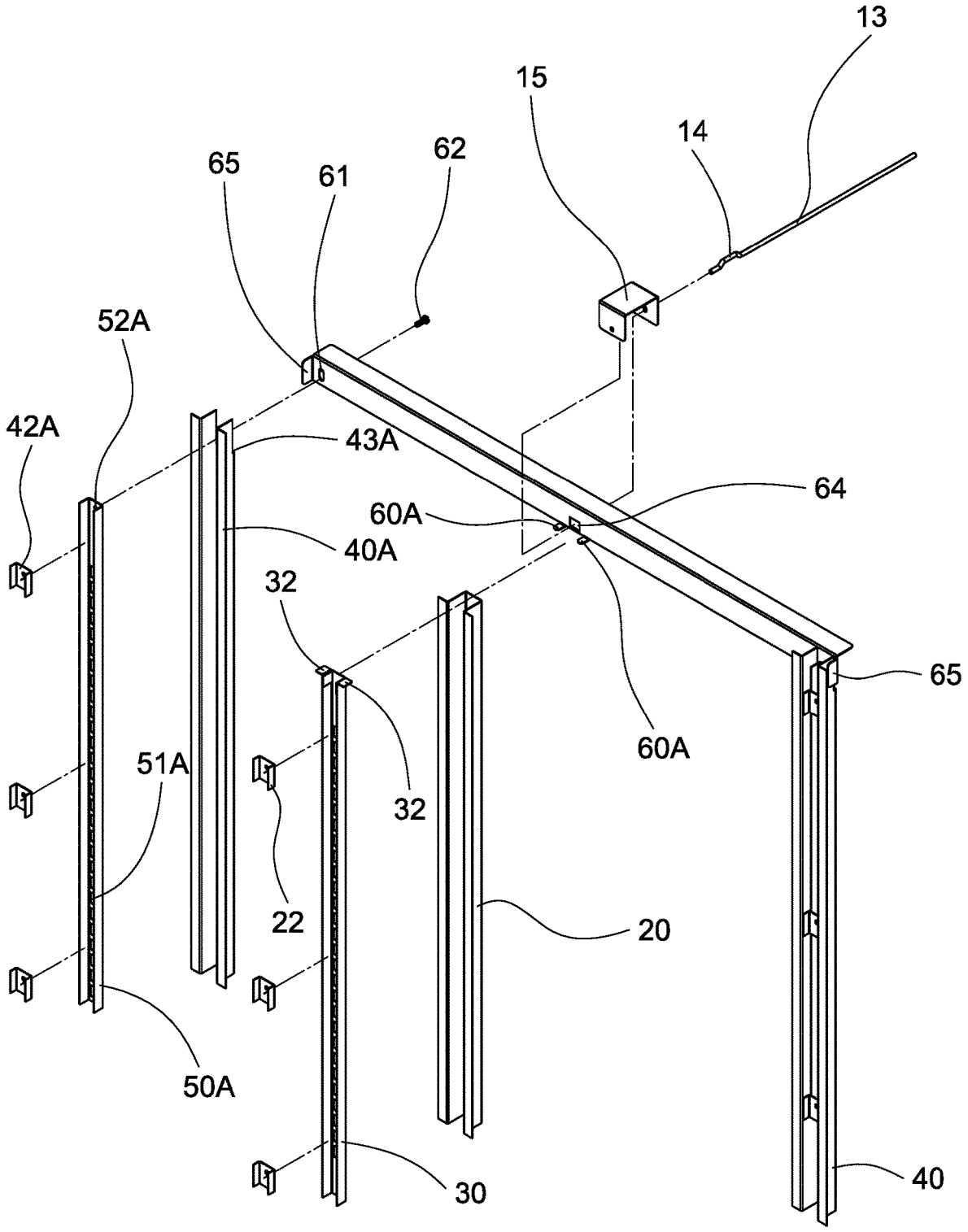
FIG. 3B is another view of FIG. 3A.
Figure 4:
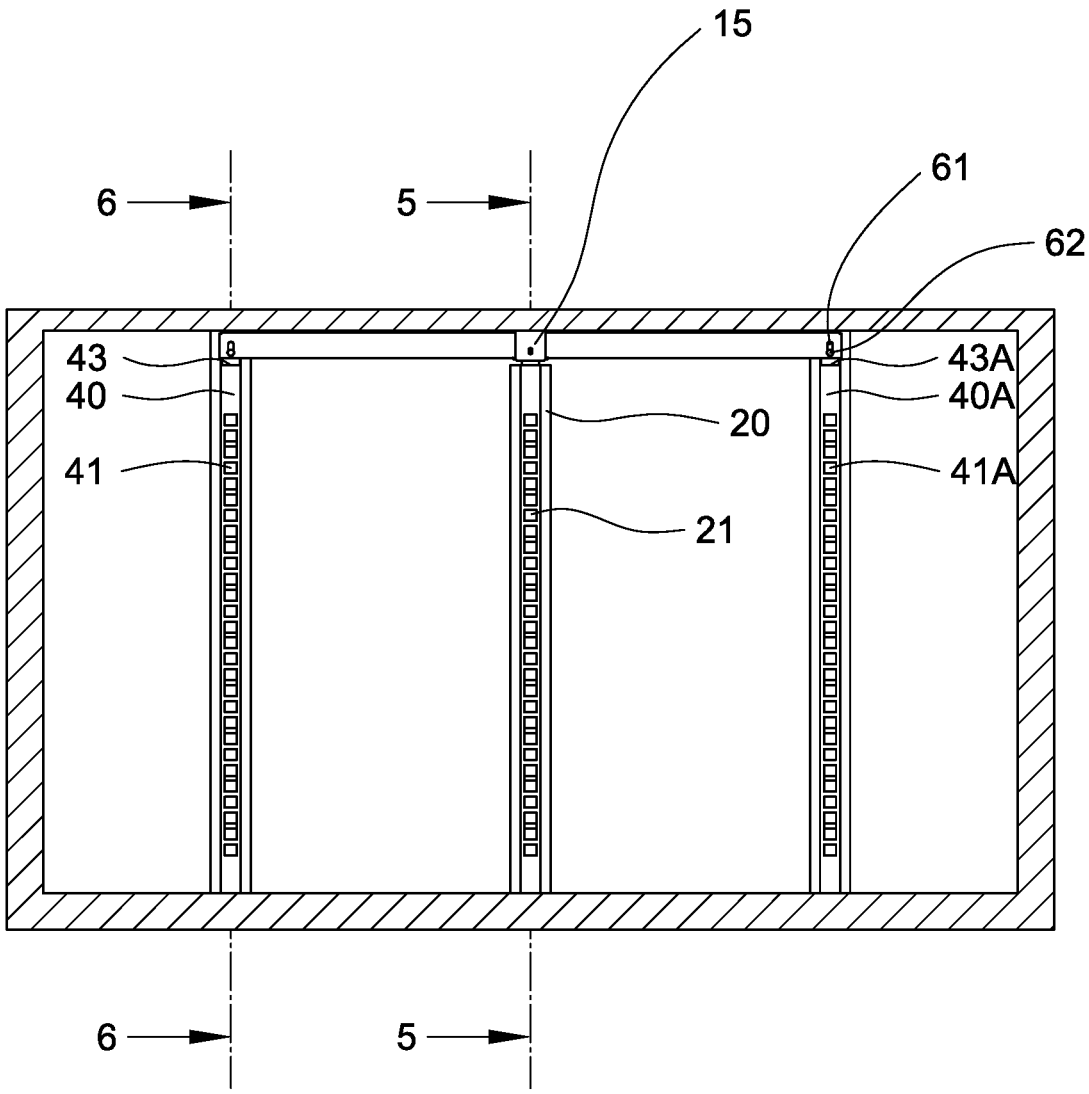
FIG. 4 is a longitudinal sectional view showing the drawers being unlocked.
Figure 5:
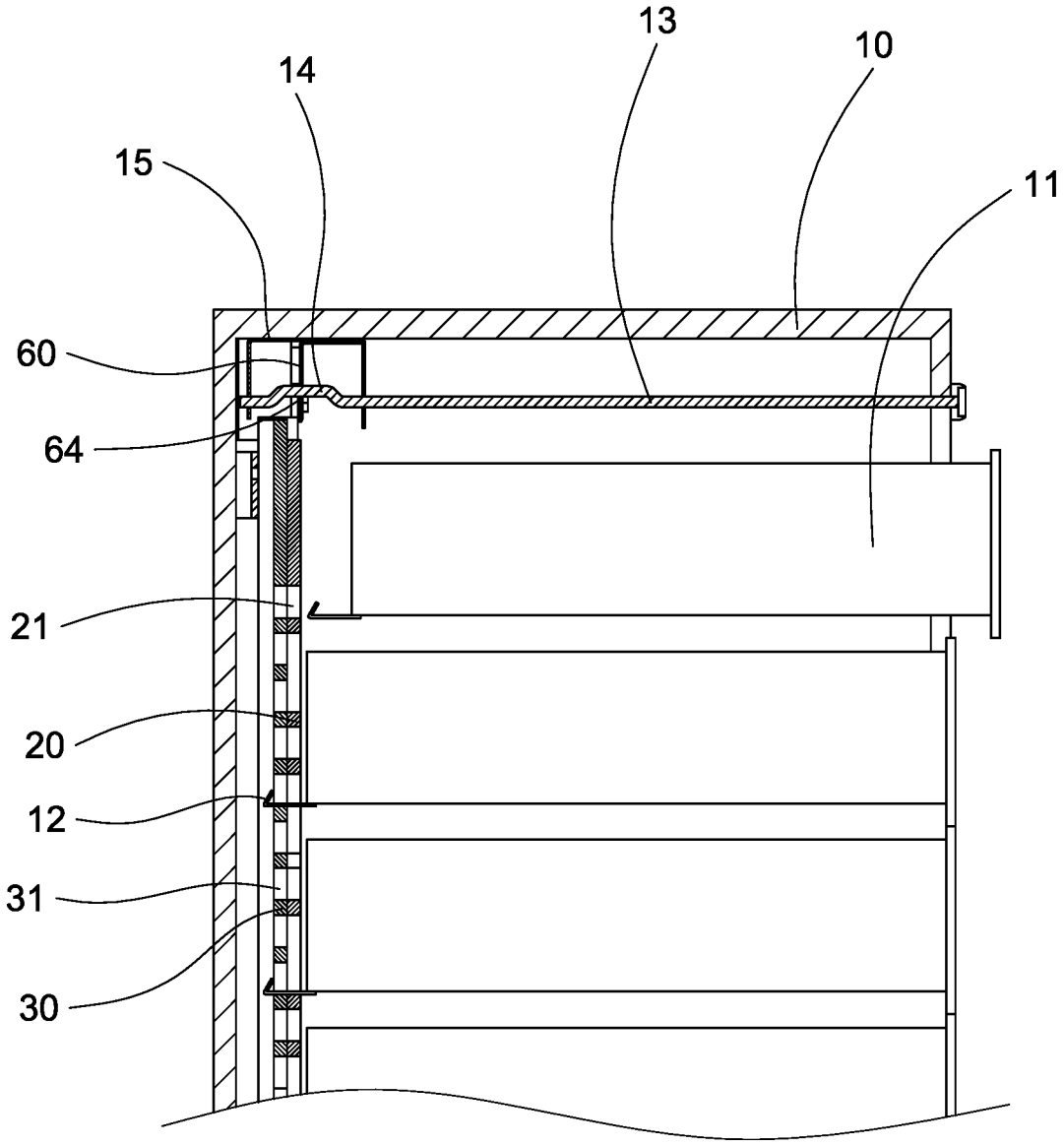
FIG. 5 is a sectional view taken along line 5-5 of FIG. 4.
Figure 6:
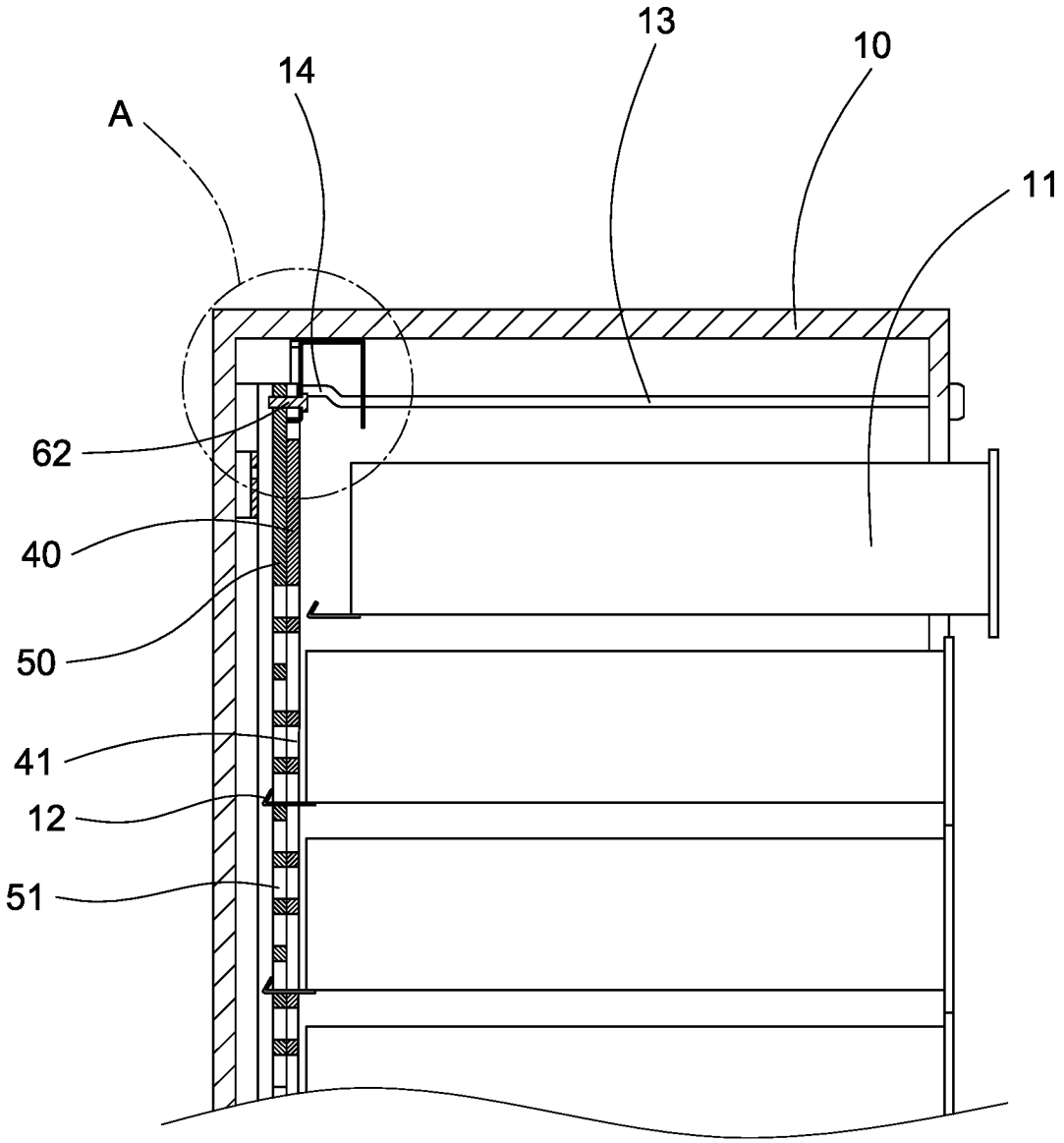
FIG. 6 is a sectional view taken along line 6-6 of FIG. 4.
Figure 7:
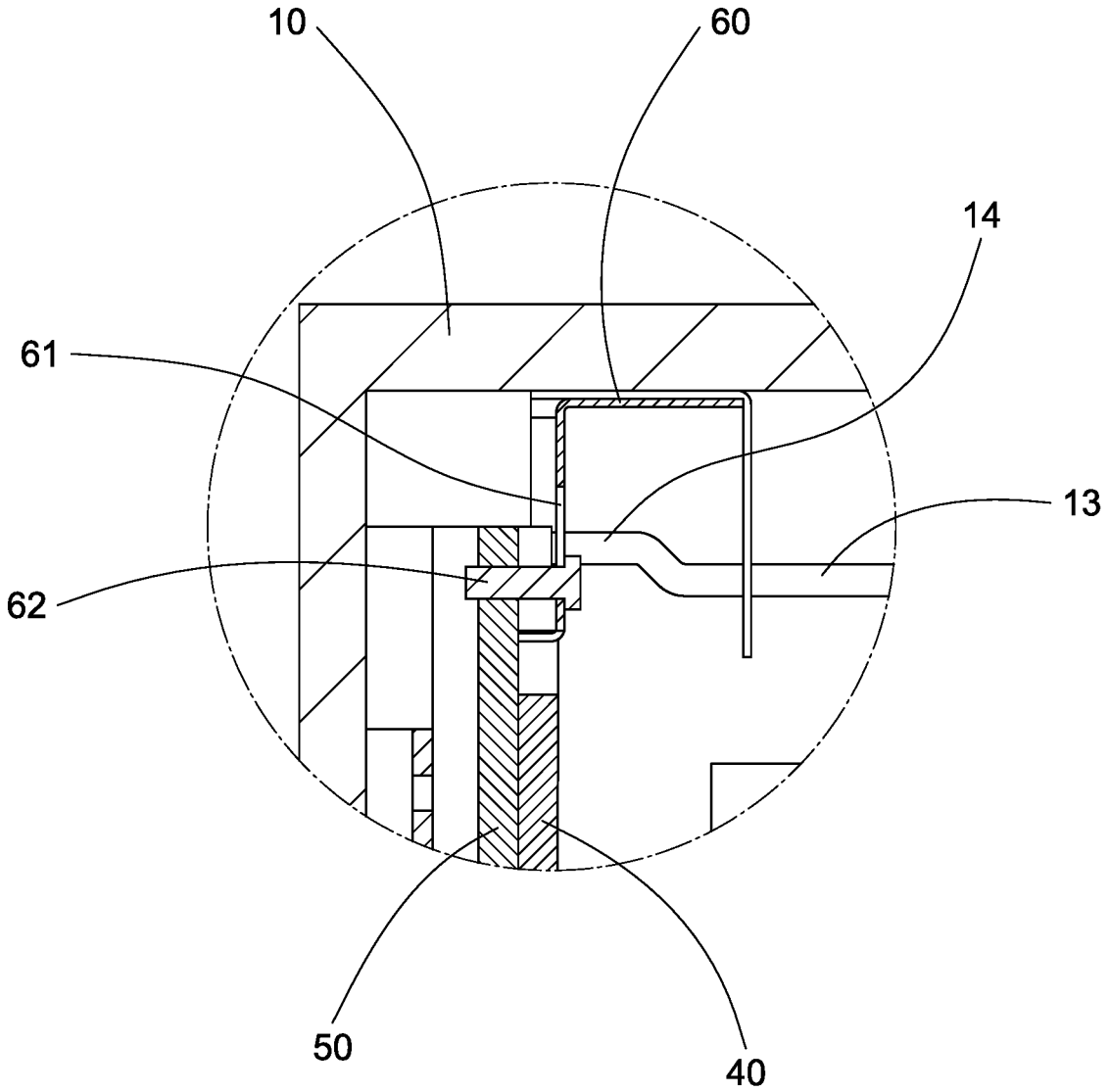
FIG. 7 is an enlarged view of the area in circle A of FIG. 6.
Figure 8:
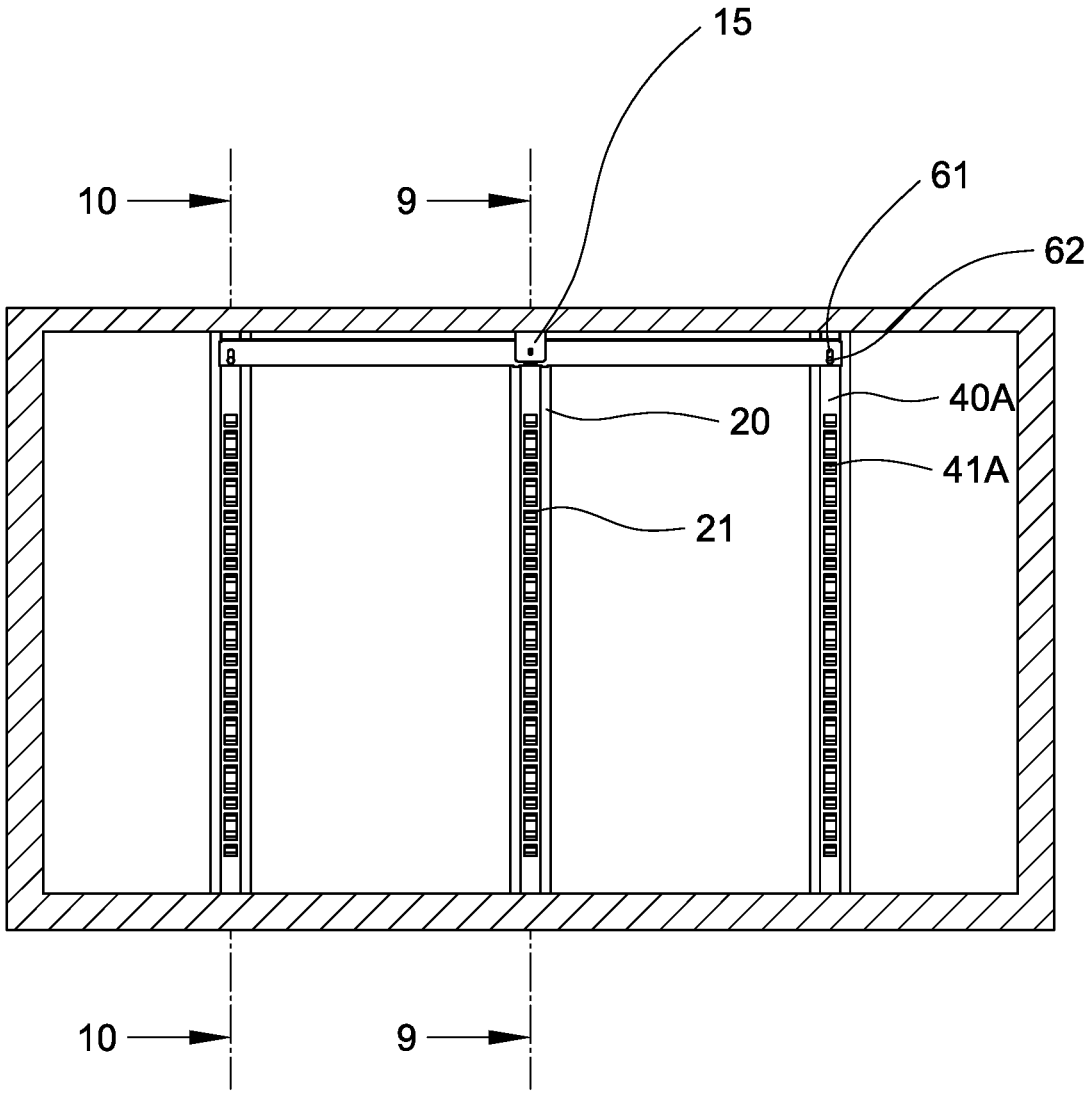
FIG. 8 is a longitudinal sectional view showing the topmost drawer being unlocked and the remaining drawers being locked.
Figure 9:
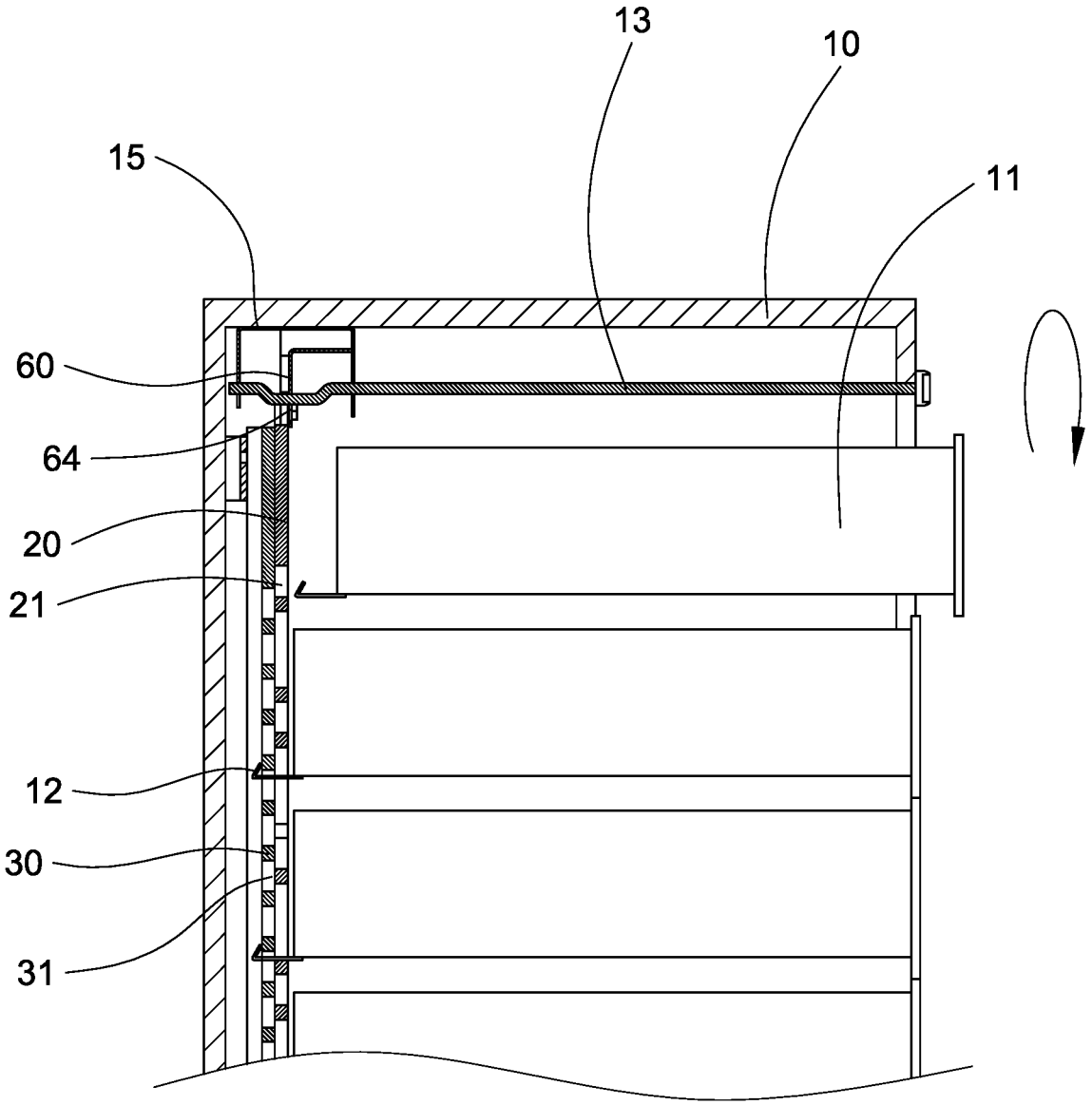
FIG. 9 is a sectional view taken along line 9-9 of FIG. 8.
Figure 10:
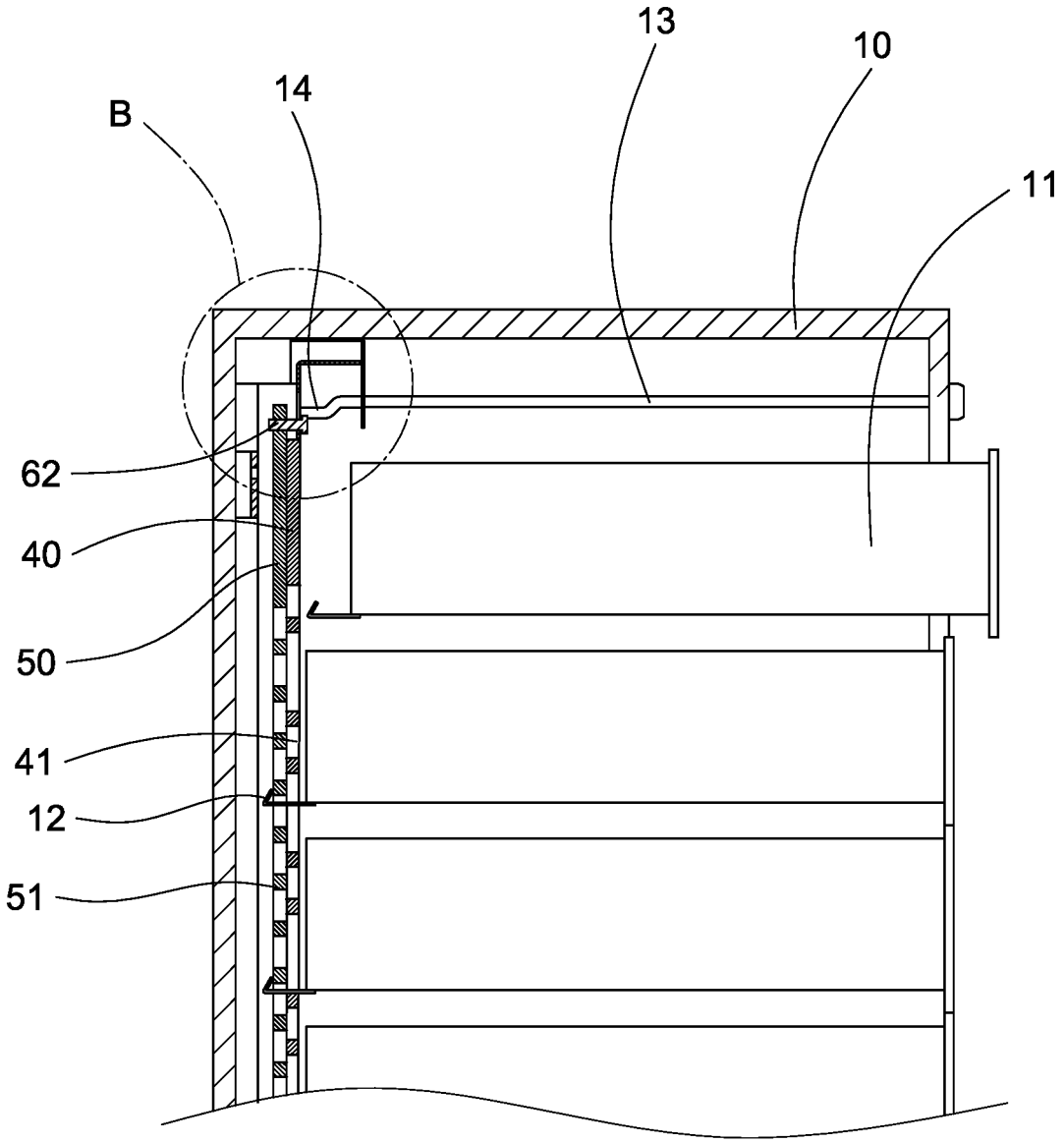
FIG. 10 is a sectional view taken along line 10-10 of FIG. 8.
Figure 11:
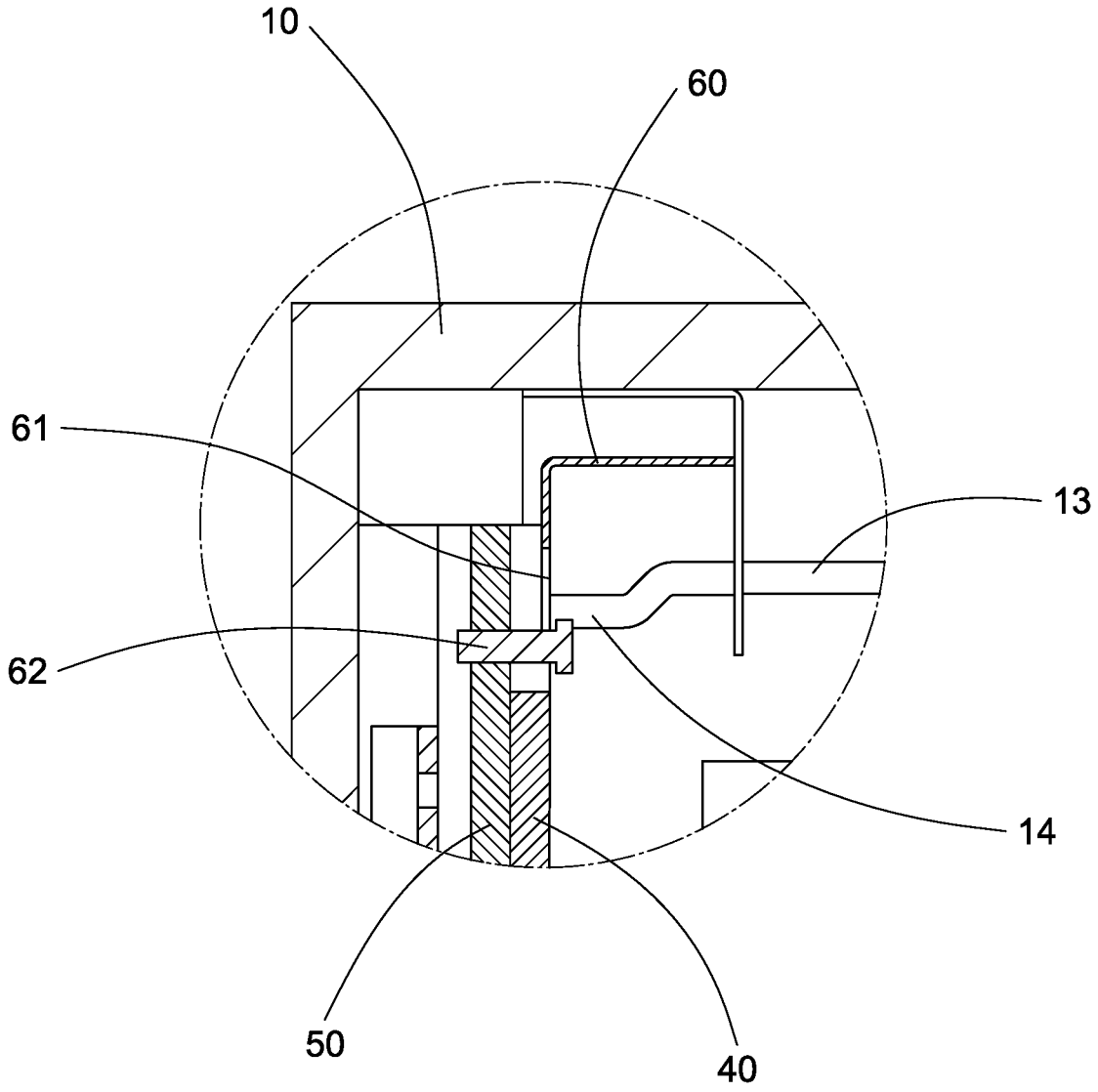
FIG. 11 is an enlarged view of the area in circle B of FIG. 10.
Figure 12:
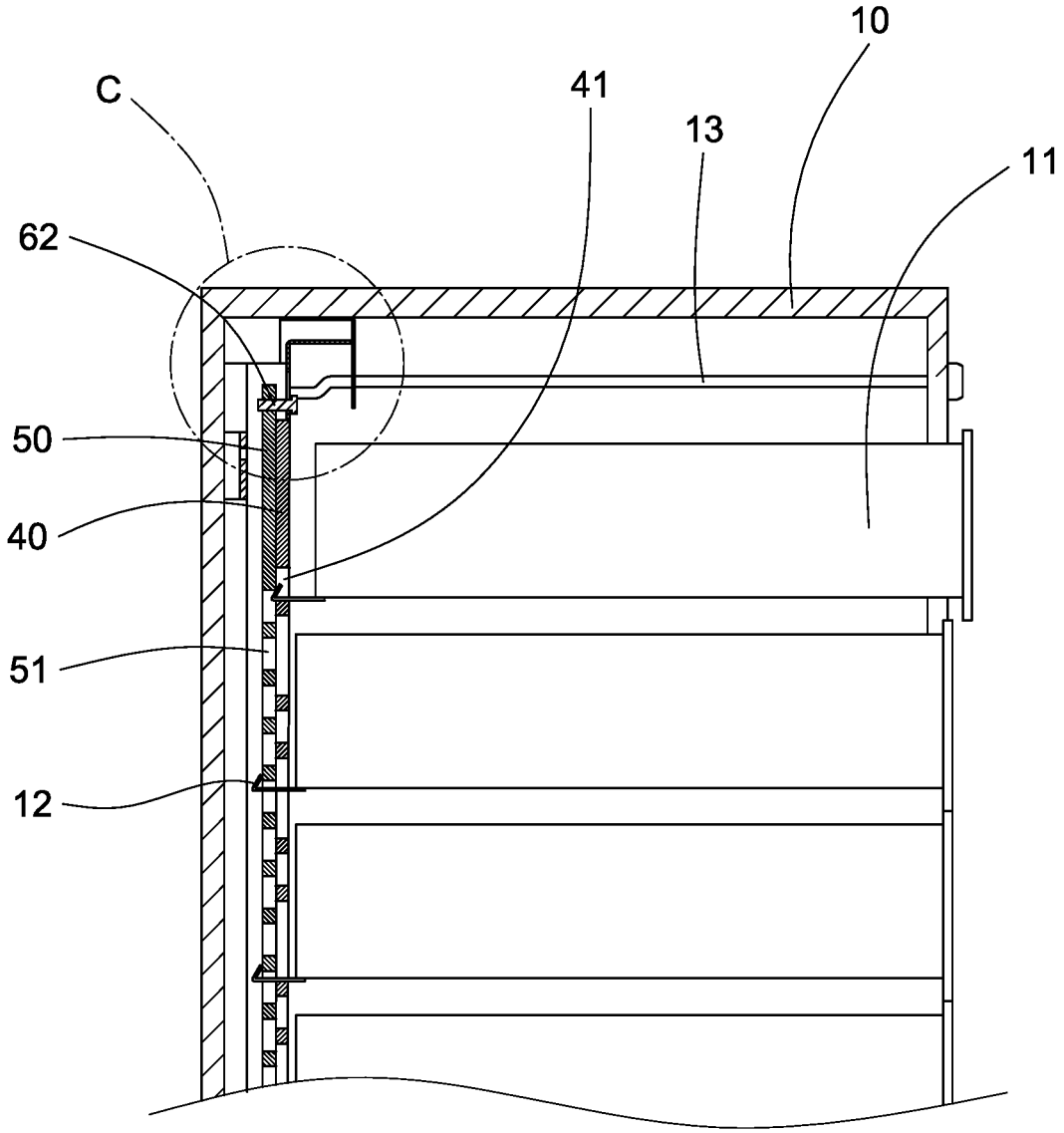
FIG. 12 is a view similar to FIG. 5 showing the topmost drawer being pushed rearward to be locked.
Figure 13:
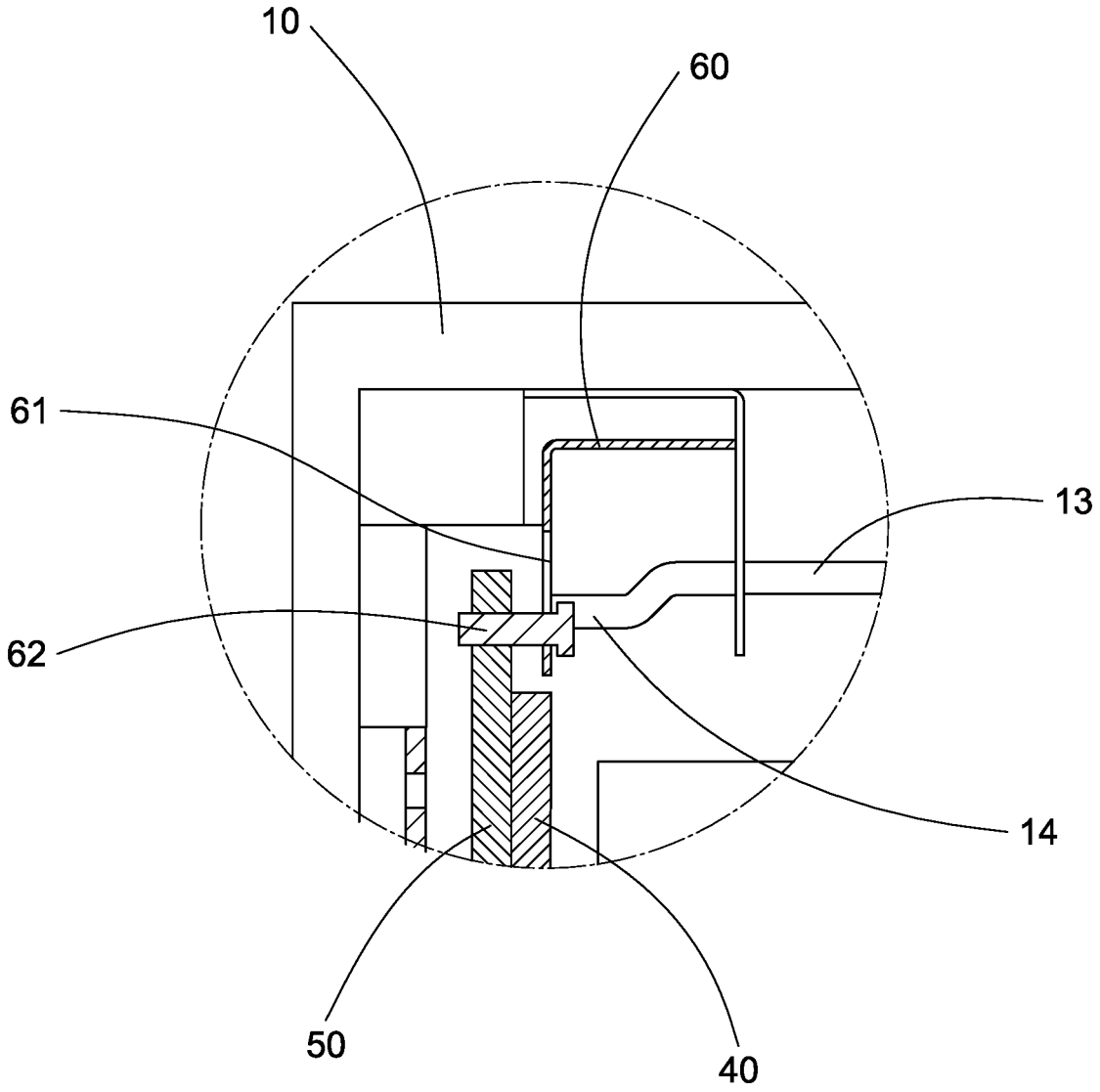
FIG. 13 is an enlarged view of the area in circle C of FIG. 12.

Referring to FIGS. 1 to 13, a cabinet 10 comprises a plurality of drawers 11 in which a lowest, large drawer 11 has two hooks 12 on a rear end of a bottom and small drawers 11 have one hook 12 on a rear end of a bottom.

The drawer locking apparatus comprises the following components as described in detail below.

A rod 13 has one end proximate a center of a rear end of a top of the cabinet 10 and the other end extending out of a front end of the top thereof so that the rod 13 can be turned after inserting a key into the rod 13 and turning the key (see FIG. 1). One end of the rod 13 in a support 15 is bent to form a pushing member 14. The support 15 has an n-shaped longitudinal section.

A first pole 20 is elongated and hollow and has an open rear end. The first pole 20 is proximate the center of the rear end of the cabinet 10. The first pole 20 includes a plurality of equally spaced apertures 21 facing the hooks 12 and configured to be inserted by the hooks 12.

A first sliding member 30 is elongated and hollow and is slidably disposed in the first pole 20. A plurality of guide members 22 are provided in the first sliding member 30 and secured to the center of the rear end of the cabinet 10. Thus, the first sliding member 30 is capable of vertically sliding between the first pole 20 and the guide members 22. The first sliding member 30 includes two side extensions 32 on a top and a plurality of holes 31 facing the apertures 21 so that a hook 12 may be inserted through the aperture 21 into the hole 31.

A second pole 40 is elongated and hollow and is proximate one side of the cabinet 10. The second pole 40 is parallel to the first pole 20. The second pole 40 includes a plurality of equally spaced apertures 41 facing the hooks 12 and configured to be inserted through by the hooks 12.

A second sliding member 50 is elongated and hollow and is slidably disposed in the second pole 40. A plurality of guide members 42 are provided in the second sliding member 50 and secured to a left portion of the rear end of the cabinet 10. Thus, the second sliding member 50 is capable of vertically sliding between the second pole 40 and the guide members 42. The second sliding member 50 includes a through hole 52 on a top and a plurality of holes 51 facing the apertures 41 so that a hook 12 may be inserted through the aperture 41 into the hole 51.

A third pole 40A is elongated and hollow and is proximate the other side of the cabinet 10. The third rod 40A is parallel to the first pole 20. The third pole 40A includes a plurality of equally spaced apertures 41A facing the hooks 12 and configured to be inserted through by the hooks 12.

A third sliding member 50A is elongated and hollow and is slidably disposed in the third pole 40A. A plurality of guide members 42A are provided in the third sliding member 50A and secured to a right portion of the rear end of the cabinet 10. Thus, the third sliding member 50A is capable of vertically sliding between the third pole 40A and the guide members 42A. The third sliding member 50A includes a through hole 52A on a top and a plurality of holes 51A facing the apertures 41A so that a hook 12 may be inserted through the aperture 41A into the hole 51A.

A linking bar 60 is horizontally disposed on tops of the first pole 20, the second pole 40 and the third pole 40A and passes through the support 15. The linking bar 60 comprises a through hole 64 with the pushing member 14 of the rod 13 passing through; two tabs 60A disposed on a bottom at two sides of the through hole 64 and engaged with bottoms of the side extensions 32 respectively so that weight of the first sliding member 30 is supported by the linking bar 60; two limit plates 65 at two sides respectively and urging against the second pole 40 and the third pole 40A respectively; two slots 61 proximate the limit plates 65 respectively and aligned with the through hole 52 of the second sliding member 50 and the through hole 52A of the third sliding member 50A respectively; and two threaded fasteners 62 in which one threaded fastener 62 passes through one slot 61 and is driven into the through hole 52 and the other threaded fastener 62 passes through the other slot 61 and is driven into the through hole 52A so that the linking bar 60, the first sliding member 30, the second sliding member 50 and the third sliding member 50A can move upward or downward as a whole.

The second pole 40 further comprises a top groove 43 and the third pole 40A further comprises a top groove 43A. Heights of the second pole 40 and the third pole 40A are the same. Height of the first pole 20 is less than that of the second pole 40. Top of the first pole 20 is flushed with a bottom of the groove 43 or 43A. In a locked position, bottom of the linking bar 60 is rested upon the first pole 20 and the grooves 43, 43A (see FIG. 8).

As shown in FIGS. 4 to 7 specifically, the drawers 11 are unlocked as detailed below. The pushing member 14 has an elevation greater than that of the rod 13 after turning upward to move the through hole 64 upward. Also, the linking bar 60 moves upward. Further, the first sliding member 30 moves upward because the side extensions 32 move upward after the tabs 60A have moved upward. Also, the third sliding member 50A moves upward due to fastening at one side of the linking bar 60 and the second sliding member 50 moves upward due to fastening at the other side of the linking bar 60. As such, the holes 31 of the first sliding member 30 are aligned with the apertures 21 of the first pole 20, the holes 51 of the second sliding member 50 are aligned with the apertures 41 of the second pole 40, and the holes 51A of the third sliding member 50A are aligned with the apertures 41A of the third pole 40A respectively. As a result, the hooks 12 of the drawers 11 are allowed to pass through the holes 31, 51 and 51A and the apertures 21, 41 and 41A.

As shown in FIGS. 8 to 13 specifically, the topmost drawer 11 is unlocked and the remaining drawers 11 are lacked as detailed below. The pushing member 14 has an elevation less than that of the rod 13 after turning downward to move the through hole 64 downward. Also, the linking bar 60 moves downward. Further, the first sliding member 30 moves downward because the side extensions 32 move downward after the tabs 60A have moved downward. Also, both the third sliding member 50A and the second sliding member 50 move downward. As such, the holes 31 of the first sliding member 30 are not aligned with the apertures 21 of the first pole 20, the holes 51 of the second sliding member 50 are not aligned with the apertures 41 of the second pole 40, and the holes 51A of the third sliding member 50A are not aligned with the apertures 41A of the third pole 40A respectively. As a result, the hooks 12 of the drawers 11 except the topmost drawer 11 are blocked by either the first sliding member 30 and the second sliding member 50 or the third sliding member 50A and the drawers 11 except the topmost drawer 11 are held motionless.

Regarding the topmost drawer 11, a pushing of the topmost drawer 11 moves its hook 12 to pass through the aperture 21 and the hole 31 and the hook 12 pushes the first sliding member 30 upward after contacting it. In the pushing operation of the hook 12, the linking bar 60 is held motionless. The first sliding member 30 immediately falls due to its weight after the hook 12 passing the hole 31. As an end, the hook 12 is blocked by the first sliding member 30 and the topmost drawer 11 is locked.

Figure 14:
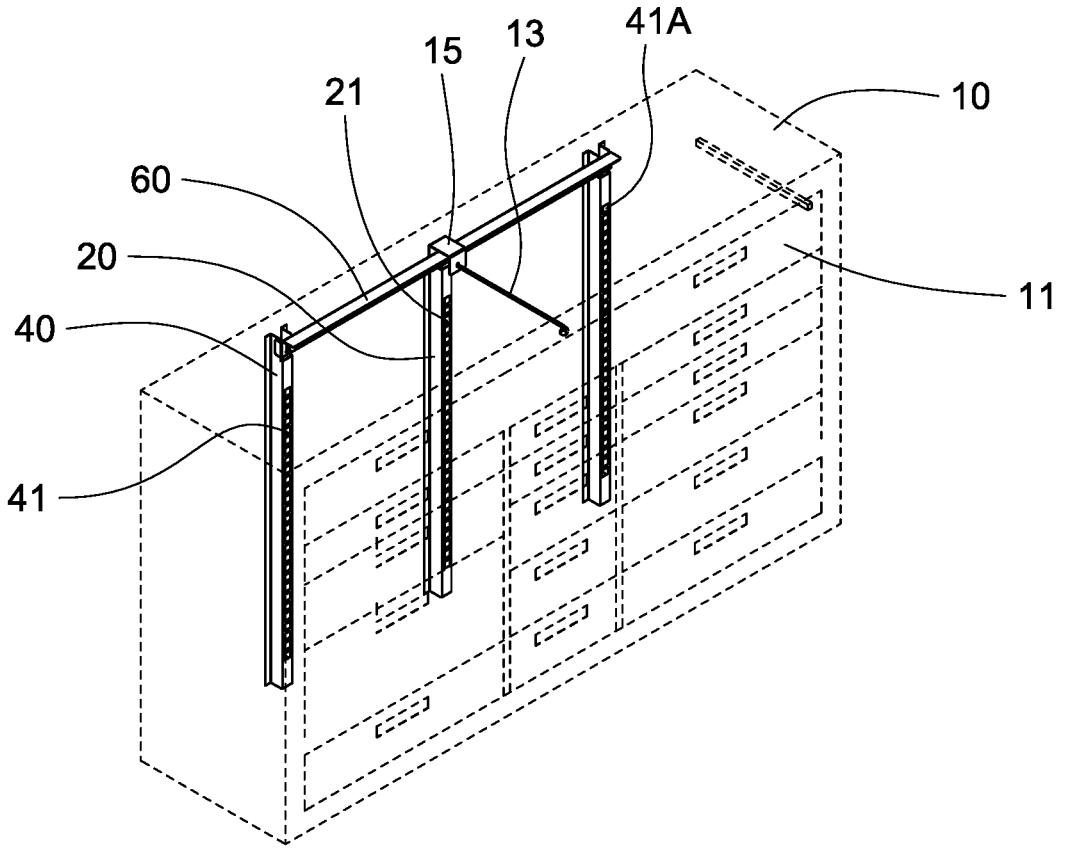
FIG. 14 is a perspective, phantom view of a cabinet incorporating a drawer locking apparatus according to a second preferred embodiment of the invention.

Referring to FIG. 14, a drawer locking apparatus of a cabinet 10 in accordance with a second preferred embodiment of the invention is shown. The characteristics of the second preferred embodiment are substantially the same as that of the first preferred embodiment except the following: The topmost drawer 11 is the largest drawer 11 and has a plurality of hooks 12 on a rear end of a bottom.

While the invention has been described in terms of preferred embodiments, those skilled in the art will recognize that the invention can be practiced with modifications within the spirit and scope of the appended claims.

What is claimed is:

1. A cabinet, comprising:

a plurality of drawers each including at least one hook on a rear end of a bottom;

a rod having one end proximate a center of a rear end of a top of the cabinet and the other end extending out of a front end of the top thereof wherein one end of the rod in a hollow support is bent to form a pushing member;

a hollow first pole proximate the center of the rear end of the cabinet and including a plurality of apertures facing the hooks and configured to allow the hooks to pass through;

a hollow first sliding member disposed in the first pole and including two side extensions on a top and a plurality of holes facing the apertures of the first pole;

a plurality of first guide members in the first sliding member and secured to the center of the rear end of the cabinet;

a hollow second pole proximate one side of the cabinet and including a plurality of apertures facing the hooks and configured to allow the hooks to pass through;

a hollow second sliding member in the second pole and including a through hole on a top and a plurality of holes facing the apertures of the second pole so that the hook is configured to insert through the aperture of the second pole into the hole of the second sliding member;

a plurality of second guide members in the second sliding member and secured to a left portion of the rear end of the cabinet so that the second sliding member is capable of vertically sliding between the second pole and the second guide members;

a hollow third pole proximate the other side of the cabinet and including a plurality of apertures facing the hooks and configured to be inserted through by the hooks;

a hollow third sliding member in the third pole and including a through hole on a top and a plurality of holes facing the apertures of the third pole so that the hook is configured to insert through the aperture of the third pole into the hole of the third sliding member;

a plurality of third guide members in the third sliding member and secured to a right portion of the rear end of the cabinet so that the third sliding member is capable of vertically sliding between the third pole and the third guide members;

a linking bar horizontally disposed on tops of the first pole, the second pole, and the third pole and configured to pass through the support, the linking bar including a through hole with the pushing member passing through, two limit plates at two sides respectively and urging against the second pole and the third pole respectively, two slots proximate the limit plates respectively and aligned with the through hole of the second sliding member and the through hole of the third sliding member respectively; and two tabs disposed on a bottom at two sides of the through hole of the linking bar, and wherein the tabs are engaged with bottoms of the side extensions respectively so as to support the first sliding member.

* * * * *